US012357037B1

(12) United States Patent
Ward

(10) Patent No.: US 12,357,037 B1
(45) Date of Patent: Jul. 15, 2025

(54) HEAT APPLIED PATCH ASSEMBLY FOR BRASSIERE PADDING AND BRASSIERE

(71) Applicant: Jodi Ward, Saraland, AL (US)

(72) Inventor: Jodi Ward, Saraland, AL (US)

( * ) Notice: Subject to any disclaimer, the term of this patent is extended or adjusted under 35 U.S.C. 154(b) by 399 days.

(21) Appl. No.: 17/991,879

(22) Filed: Nov. 22, 2022

(51) Int. Cl.
*A41C 3/14* (2006.01)
*A41C 5/00* (2006.01)

(52) U.S. Cl.
CPC ..... *A41C 3/144* (2013.01); *A41C 5/00* (2013.01)

(58) Field of Classification Search
CPC ..... A41C 3/144; A41C 5/00
See application file for complete search history.

(56) References Cited

U.S. PATENT DOCUMENTS 3,574,667 A 4/1971 Fournier
4,674,510 A 6/1987 Sneider
5,165,113 A * 11/1992 Hyams ..... A41F 15/00 450/86
5,507,681 A * 4/1996 Smith ..... A41F 15/00 2/243.1
5,569,345 A 10/1996 Kenyon
5,614,303 A * 3/1997 Baigas, Jr. ..... D04H 1/4374 442/247
6,134,755 A 10/2000 McDaniel
6,810,534 B2 * 11/2004 Durkin ..... A41D 13/0581 2/455
7,861,324 B2 1/2011 Chetelat
9,629,753 B2 4/2017 Golubovic
D851,358 S 6/2019 Prinz
2007/0289047 A1 * 12/2007 Fortner ..... A41C 3/144 2/268
2022/0330626 A1 * 10/2022 Wiese ..... A41C 3/10

FOREIGN PATENT DOCUMENTS

WO 2006107773 10/2006

* cited by examiner

*Primary Examiner* — Gloria M Hale
(74) *Attorney, Agent, or Firm* — Kyle A. Fletcher, Esq.

(57) ABSTRACT

The applied patch assembly for brassiere padding and brassiere is a garment. The applied patch assembly for brassiere padding and brassiere comprises a brassiere, a pad structure, and a fastening structure. The pad structure inserts into the brassiere. The fastening structure secures the pad structure within the brassiere. The fastening structure secures the pad structure into a fixed position within the brassiere.

12 Claims, 7 Drawing Sheets

HEAT APPLIED PATCH ASSEMBLY FOR BRASSIERE PADDING AND BRASSIERE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of aftermarket component parts for a brassiere. (A41C3/12)

SUMMARY OF INVENTION

The applied patch assembly for brassiere padding and brassiere is a garment. The applied patch assembly for brassiere padding and brassiere comprises a brassiere, a pad structure, and a fastening structure. The pad structure inserts into the brassiere. The fastening structure secures the pad structure within the brassiere. The fastening structure secures the pad structure into a fixed position within the brassiere.

These together with additional objects, features and advantages of the applied patch assembly for brassiere padding and brassiere will be readily apparent to those of ordinary skill in the art upon reading the following detailed description of the presently preferred, but nonetheless illustrative, embodiments when taken in conjunction with the accompanying drawings.

In this respect, before explaining the current embodiments of the applied patch assembly for brassiere padding and brassiere in detail, it is to be understood that the applied patch assembly for brassiere padding and brassiere is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the applied patch assembly for brassiere padding and brassiere.

It is therefore important that the claims be regarded as including such equivalent construction insofar as they do not depart from the spirit and scope of the applied patch assembly for brassiere padding and brassiere. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
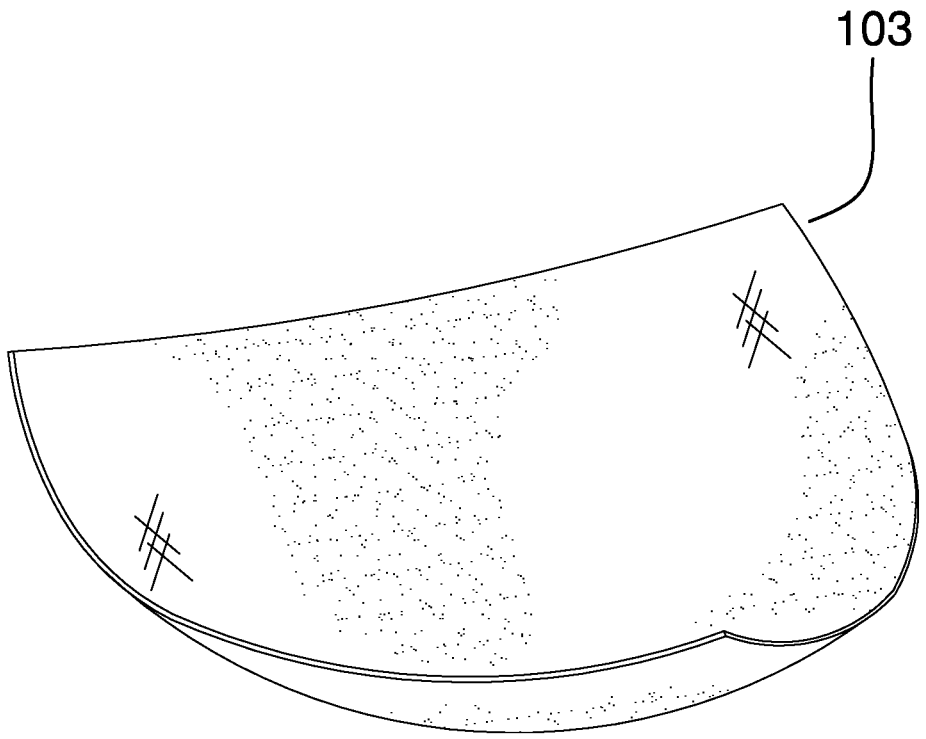
FIG. 1 is a perspective view of an embodiment of the disclosure.
Figure 2:
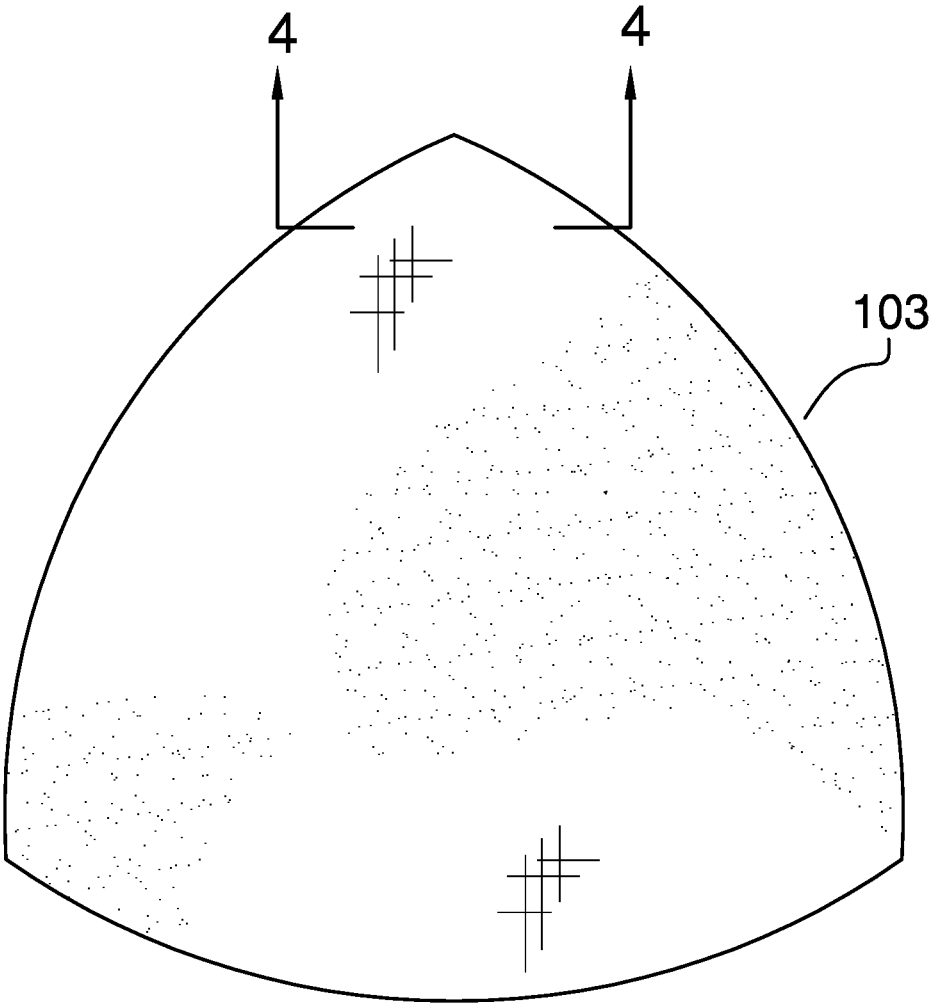
FIG. 2 is a front view of an embodiment of the disclosure.
Figure 3:
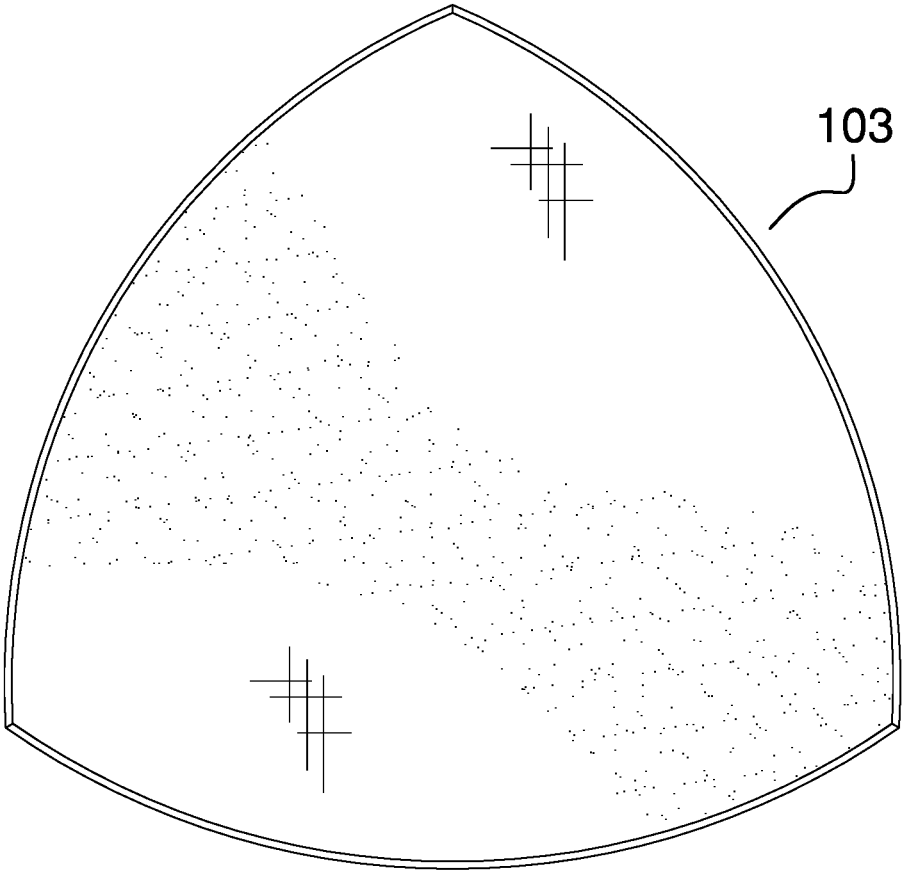
FIG. 3 is a rear view of an embodiment of the disclosure.
Figure 4:
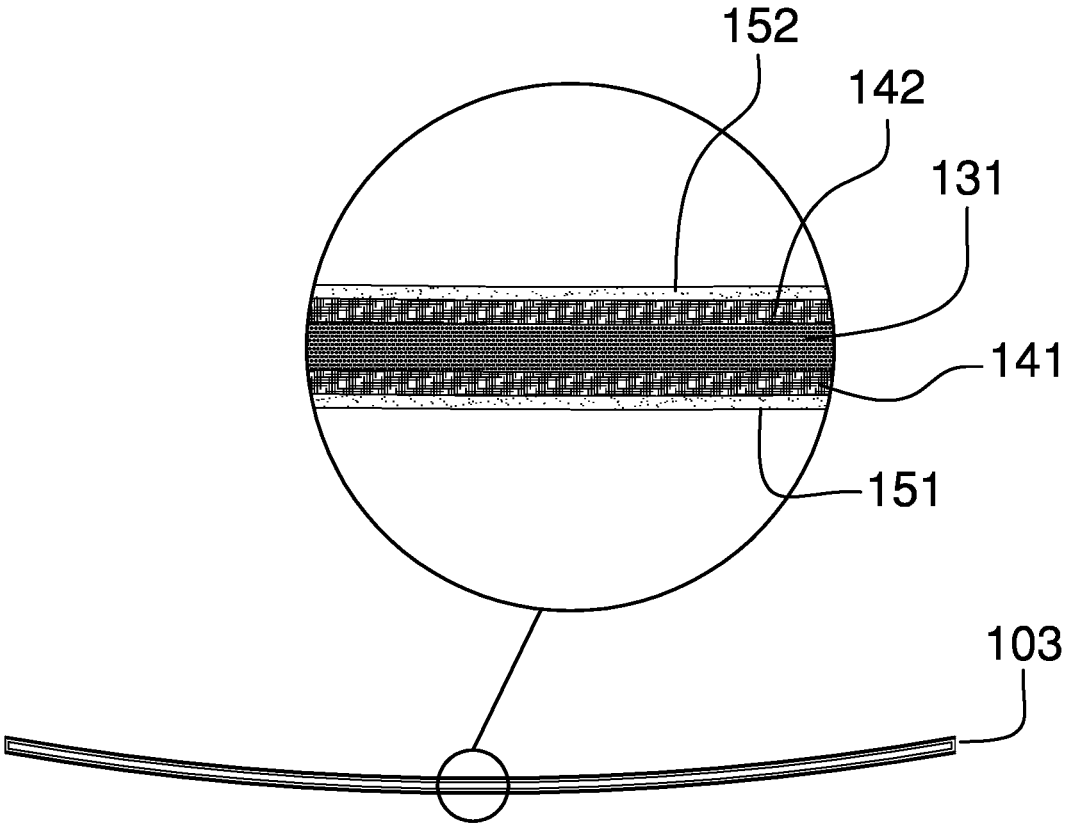
FIG. 4 is a cross-sectional view of an embodiment of the disclosure across 4-4 as shown in FIG. 2.
Figure 5:
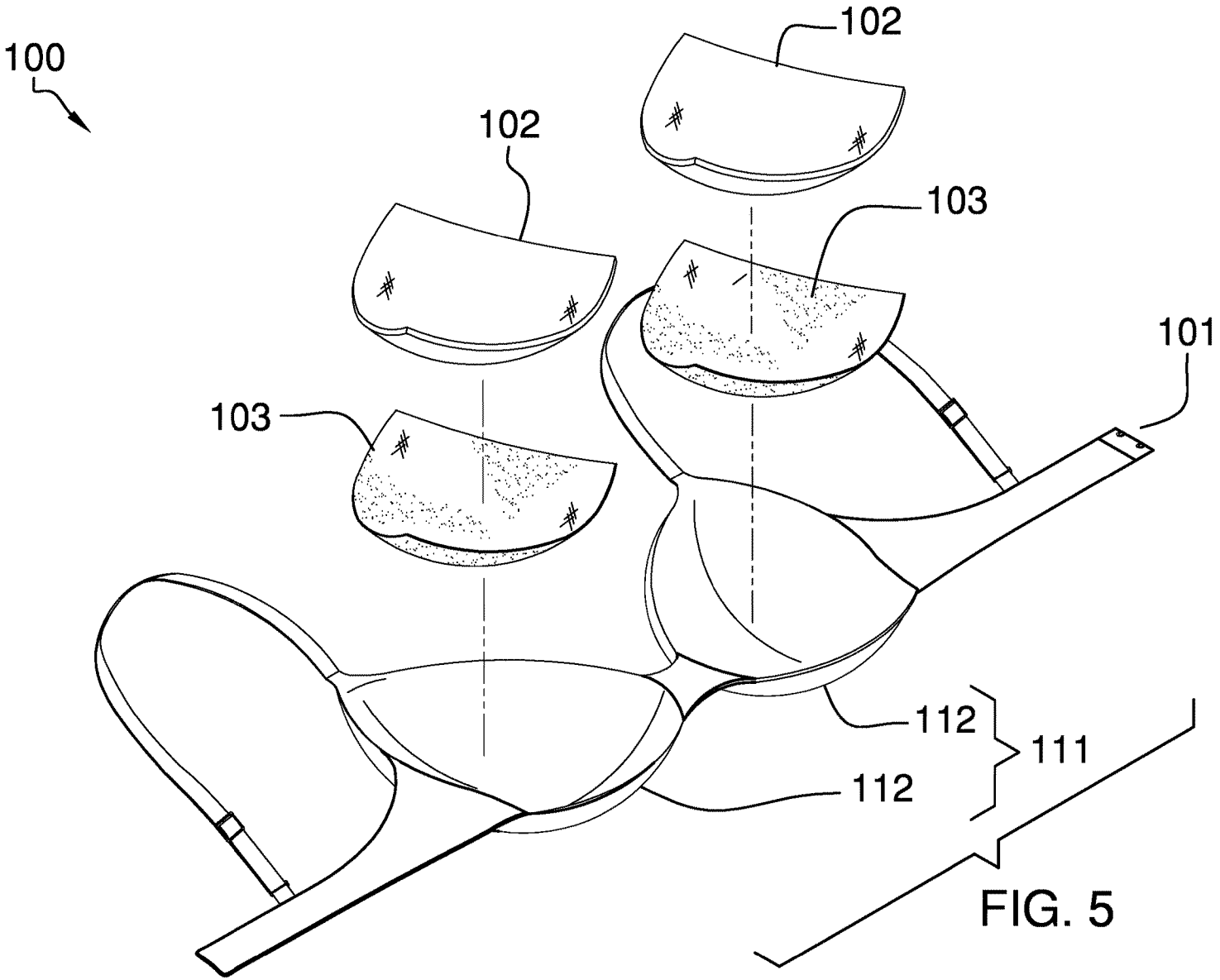
FIG. 5 is an exploded view of an embodiment of the disclosure.
Figure 6:
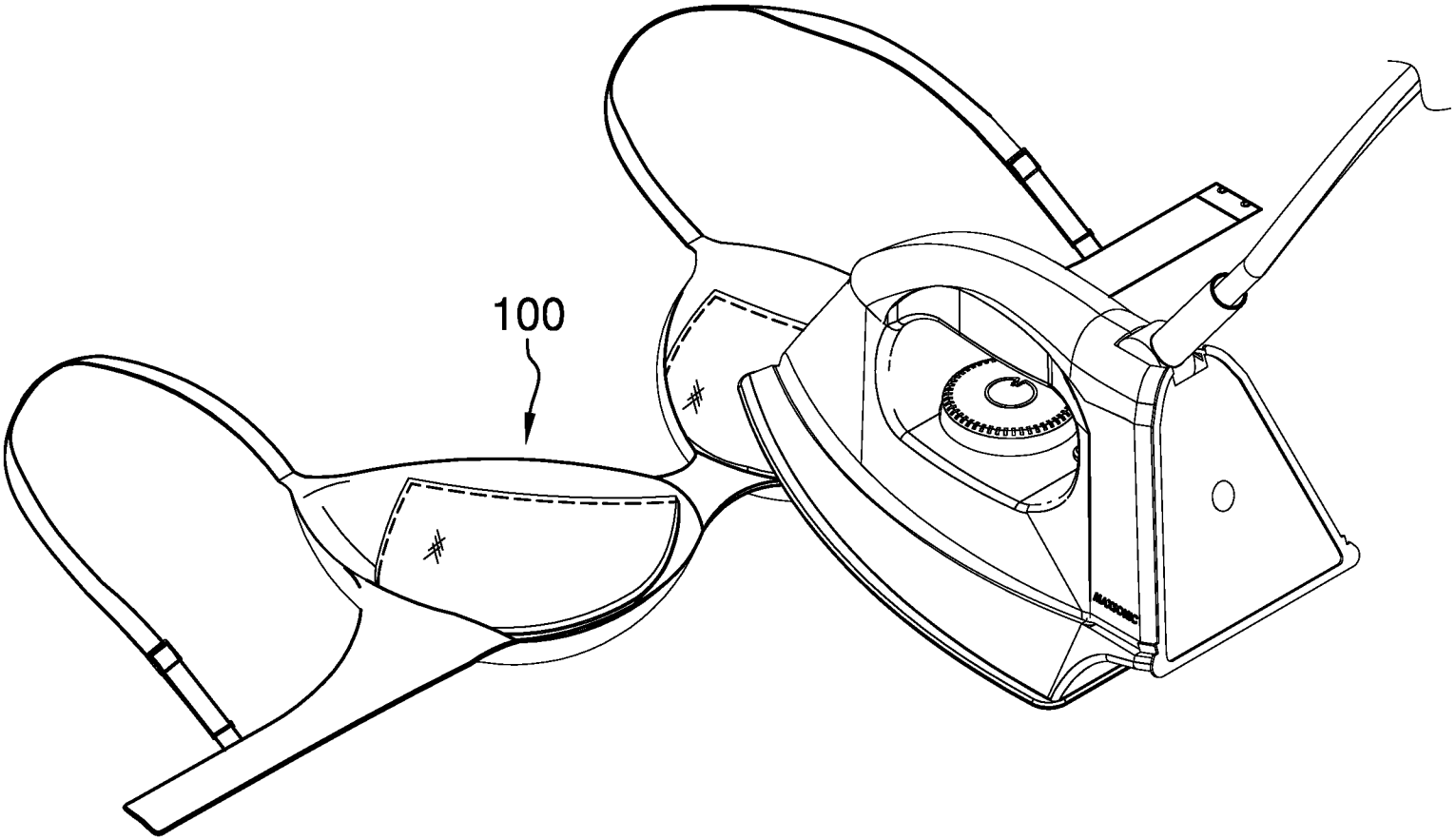
FIG. 6 is an in-use view of an embodiment of the disclosure.
Figure 7:
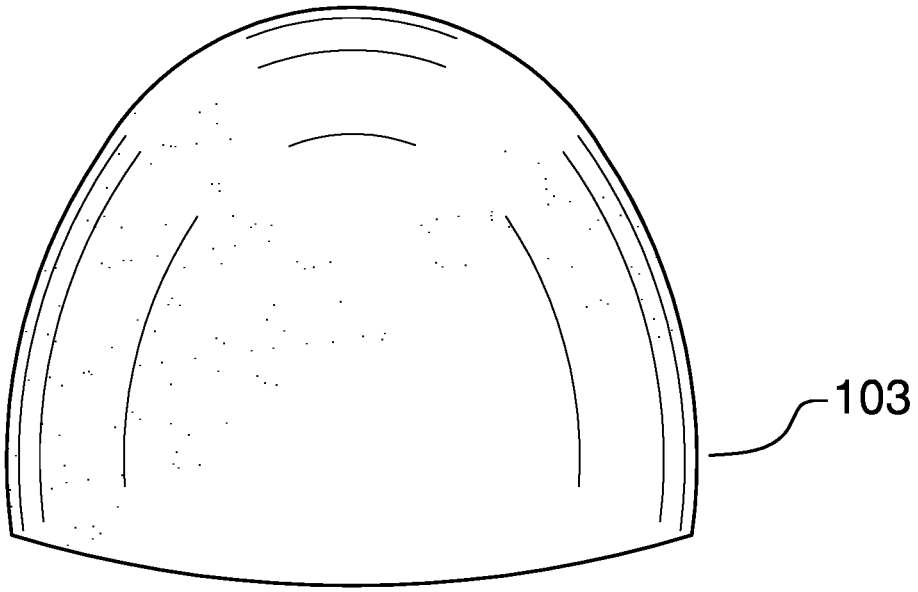
FIG. 7 is a front view of an alternate embodiment of the disclosure.
Figure 8:
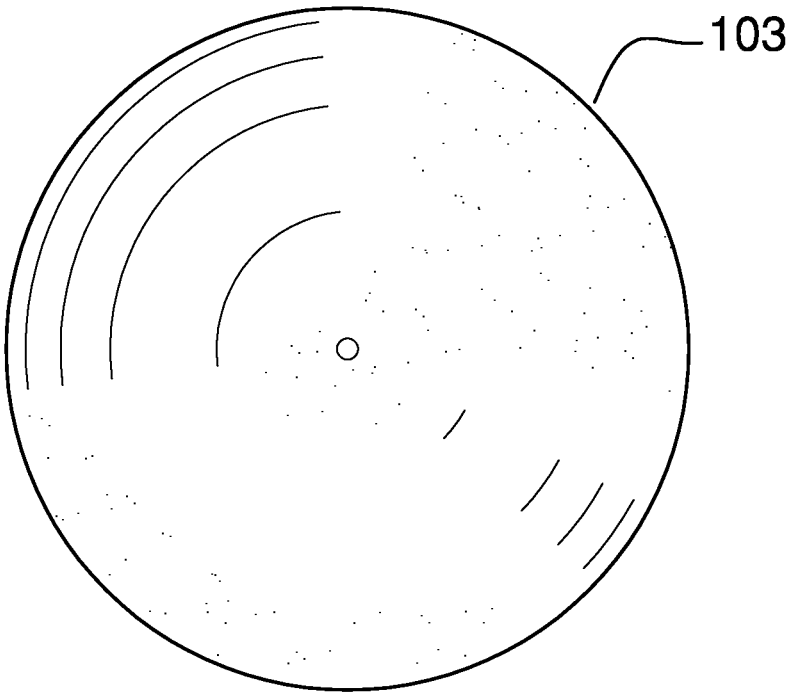
FIG. 8 is a front view of an alternate embodiment of the disclosure.

Detailed reference will now be made to one or more potential embodiments of the disclosure, which are illustrated in FIGS. 1 through 8.

The applied patch assembly for brassiere padding and brassiere 100 (hereinafter invention) is a garment. The invention 100 comprises a brassiere 101, a pad structure 102, and a fastening structure 103. The pad structure 102 inserts into the brassiere 101. The fastening structure 103 secures the pad structure 102 within the brassiere 101. The fastening structure 103 secures the pad structure 102 into a fixed position within the brassiere 101.

The brassiere 101 is a garment. The brassiere 101 is defined elsewhere in this disclosure. The brassiere 101 is worn by a client. The brassiere 101 encloses the breasts of the client. The brassiere 101 further comprises a plurality of cup structures 111. The plurality of cup structures 111 comprises a collection of individual cup structures 112.

Each individual cup structure 112 selected from the plurality of cup structures 111 is a fitted structure. Each individual cup structure 112 forms a protected space that encloses the breasts of the client. Each individual cup structure 112 is a disk shaped structure. Each individual cup structure 112 is formed as a sheeting structure. Each individual cup structure 112 is formed as a non-Euclidean disk structure. The individual cup structure 112 is geometrically similar to the convex surface of the non-Euclidean disk structure of the pad structure 102 that is associated with the individual cup structure 112. The individual cup structure 112 is geometrically similar to the convex surface of the non-Euclidean disk structure of the fastening structure 103 that is associated with the individual cup structure 112. The associated fastening structure 103 fits flush within the individual cup structure 112. The associated pad structure 102 fits flush within the individual cup structure 112.

The pad structure 102 is a disk shaped structure. The pad structure 102 is an elastic structure. The pad structure 102 forms a cushion that inserts into an individual cup structure 112 selected from the plurality of cup structures 111 of the brassiere 101. The pad structure 102 has a non-Euclidean disk shape. The pad structure 102 is geometrically similar to an individual cup structure 112 selected from the plurality of cup structures 111. The pad structure 102 inserts into the individual cup structure 112 associated with the pad structure 102 such that the convex surface of the non-Euclidean disk structure of the pad structure 102 rests flush against the concave surface of the non-Euclidean disk structure of the associated individual cup structure 112. The pad structure 102 forms a protective structure that prevents the brassiere 101 from pinching the client as the brassiere 101 moves relative to the client during the motion of the client.

The fastening structure 103 is a disk shaped structure. The fastening structure 103 is an elastic structure. The fastening structure 103 forms a fastening device that secures the pad structure 102 to its associated individual cup structure 112. The fastening structure 103 secures the pad structure 102 into a fixed position relative to the associated individual cup structure 112. The fastening structure 103 is formed as a sheeting structure. The fastening structure 103 is formed as a non-Euclidean disk structure. The fastening structure 103 has a composite prism structure.

The fastening structure 103 is geometrically similar to the convex surface of the non-Euclidean disk structure of the pad structure 102. The fastening structure 103 is geometrically similar to the concave surface of the non-Euclidean disk structure of the associated individual cup structure 112. The fastening structure 103 is sandwiched between the concave surface of the non-Euclidean surface of the disk structure of the individual cup structure 112 and the convex surface of the non-Euclidean disk structure of the pad structure 102.

The fastening structure 103 comprises a foam base 131, a first textile structure 141, a second textile structure 142, a first adhesive coating 151, and a second adhesive coating 152.

The foam base 131 is a disk shaped structure. The foam base 131 is a sheeting structure. The foam base 131 forms a layer of the composite prism structure of the fastening structure 103. The foam base 131 is a flexible structure. The foam base 131 is an elastic structure. The foam base 131 has a non-Euclidean disk shape. The foam base 131 forms the primary structure of the fastening structure 103. The foam base 131 is a foam structure. The foam base 131 is formed from a polyurethane foam.

The elastic nature of the foam base 131 absorbs transient forces such that the foam base 131 prevents the pad structure 102 from shifting within the brassiere 101 as the client moves. The concave surface of the foam base 131 is geometrically similar to the convex surface of the non-Euclidean disk structure of the pad structure 102. The convex surface of the foam base 131 is geometrically similar to the concave surface of the non-Euclidean disk structure of the associated individual cup structure 112.

The first textile structure 141 is a sheeting structure. The first textile structure 141 forms a layer of the composite prism structure of the fastening structure 103. The first textile structure 141 is geometrically identical to the convex surface of the non-Euclidean disk structure of the foam base 131. The first textile structure 141 permanently attaches to the convex surface of the non-Euclidean disk structure of the foam base 131. The first textile structure 141 fully encloses the convex surface of the non-Euclidean disk structure of the foam base 131.

The second textile structure 142 is a sheeting structure. The second textile structure 142 forms a layer of the composite prism structure of the fastening structure 103. The second textile structure 142 is geometrically identical to the concave surface of the non-Euclidean disk structure of the foam base 131. The second textile structure 142 permanently attaches to the concave surface of the non-Euclidean disk structure of the foam base 131. The second textile structure 142 fully encloses the concave surface of the non-Euclidean disk structure of the foam base 131.

The foam base 131 is sandwiched between the first textile structure 141 and the second textile structure 142.

The first adhesive coating 151 is a heat activated adhesive. The first adhesive coating 151 forms a layer of the composite prism structure of the fastening structure 103. The first adhesive coating 151 is applied as a coating to the surface of the first textile structure 141 that is distal from the foam base 131. The first adhesive coating 151 adheres the convex surface of the composite prism structure of the fastening structure 103 to the concave surface of the associated individual cup structure 112.

The second adhesive coating 152 is a heat activated adhesive. The second adhesive coating 152 forms a layer of the composite prism structure of the fastening structure 103. The second adhesive coating 152 is applied as a coating to the surface of the second textile structure 142 that is distal from the foam base 131. The second adhesive coating 152 adheres the concave surface of the composite prism structure of the fastening structure 103 to the convex surface of the associated pad structure 102.

This paragraph describes the assembly of the invention 100. The fastening structure 103 and the pad structure 102 are inserted into the associated individual cup structure 112 such that: a) the convex surface of the non-Euclidean disk structure of the fastening structure 103 rests flush against the concave surface of the non-Euclidean disk structure of the associated individual cup structure 112; and simultaneously, b) the convex surface of the non-Euclidean disk structure of the pad structure 102 rests flush against the concave surface of the non-Euclidean disk structure of the fastening structure 103. The assembled structure formed by the individual cup structure 112, the fastening structure 103, and the pad structure 102 are brought to the activation temperatures of the first adhesive coating 151 and the second adhesive coating 152 to adhere the assembled structure into a single unit.

The following definitions were used in this disclosure:

Adhere: As used in this disclosure, to adhere means to attach an object to a surface such that the object remains in a fixed position on the surface. In chemistry, the use of the term adhere often implies the action of molecular bonding or intermolecular forces between the surfaces and the object. The noun form of to adhere is adhesion.

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Aftermarket Structure: As used in this disclosure, an aftermarket structure refers to a structure that modifies an object after the object has been procured and put into use.

The aftermarket structure has a purpose selected from the group consisting of: a) replacing a component or structure of the object for maintenance purposes; and, b) enhancing the function of the object beyond what was provided by the object's original state. The term aftermarket part is a synonym for aftermarket structure.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Brassiere: The brassiere is an undergarment. The brassiere is worn around the torso of a client such that the brassiere covers the one or more breasts of the client. The brassiere is a foundation garment. The brassiere comprises a plurality of cups, a plurality of wings, a plurality of posterior straps, a plurality of shoulder straps, a plurality of ring and slider arrangements, a posterior fastener, a bridge, an underline, and a neckline. Each of the plurality of cups further comprises an apex. Each of the plurality of cups encloses a breast of the client. Each of the plurality of wings is a textile panel that wraps around the lateral side of the client. Each of plurality of wings attaches a cup selected from the plurality of cups to a posterior strap selected from the plurality of posterior straps. The plurality of posterior straps fasten to each other on the posterior side of the client to secure the brassiere to the client. The plurality of posterior straps are fastened to each other using the posterior fastener. The plurality of shoulder straps are load bearing structures that forms a load path to transfer the load of the one or more breasts of the client to the shoulder of the client. Each of the plurality of ring and slider arrangements is a mechanical structure used to adjust the span of the length of a shoulder strap selected from the plurality of shoulder straps. The bridge is a textile panel that interconnects the plurality of cups. The textile panel is located on the anterior side of the client directly over the medial axis of the client. The underline is the inferior edge of the brassiere. The neckline refers to the superior edge of the brassiere that is between the plurality of shoulder straps. Each shoulder strap selected from the plurality of shoulder straps attaches to a posterior strap selected from the plurality of posterior straps. Each shoulder strap selected from the plurality of shoulder straps attaches to the apex of a cup selected from the plurality of cups.

Cant: As used in this disclosure, a cant is an angular deviation from one or more reference lines (or planes) such as a vertical line (or plane) or a horizontal line (or plane).

Carbamate: As used in this disclosure, a carbamate is a functional group consisting of an O—(C═O)—N structure. Carbamate is informally referred to as urethane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coating: As used in this disclosure, a coating refers to a substance that is applied to the exterior surface of an object such that the coating forms a new exterior surface of the object. A coating is commonly said to be formed as a layer. Paint is an example of a common coating material.

Composite Material: As used in this disclosure, a composite material is a multilayer structure made of two or more joined layers of sheeting materials and coatings.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Composite Textile: As used in this disclosure, a composite textile is a multilayer fabric made of two or more joined layers of textile or sheeting materials.

Concave: As used in this disclosure, concave is used to describe: 1) a surface that resembles the interior surface of a sphere; or, 2) a function with a curvature structure wherein a chord that connects any two points of the function will be lesser than (graphically below) or equal to the value of the function at any point along the chord.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Convex: As used in this disclosure, convex is used to describe: 1) a surface that resembles the outer surface of a sphere; or, 2) a function with a curvature structure wherein a chord that connects any two points of the function will be greater than (graphically above) or equal to the value of the function at any point along the chord.

Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is an elastomeric structure formed that is used to prevent injury or damage to a person or object.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exterior: As used in this disclosure, the exterior is used as a relational term that implies that an object is not contained within the boundary of a structure or a space.

Fitted: As used in this disclosure, the term fitted refers to two geometrically similar structures wherein the smaller geometrically similar structure inserts into the larger geometrically similar structure.

Flexible: As used in this disclosure, flexible refers to an object or material that will deform when a force is applied to it but that will not necessarily return to its original shape when the deforming force is removed.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Flush: As used in this disclosure, the term flush is used to describe the alignment of a first surface and a second surface to form a single structure selected from the group consisting of a Euclidean plane and a non-Euclidean plane.

Foam: As used in this disclosure, foam is a mass of gas filled spaces, commonly referred to as bubbles, which can be formed: 1) on or in a liquid or gel; or, 2) in a solid material.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Heat Activated Adhesive: As used in this disclosure, a heat activated adhesive disclosure refers to an adhesive that is activated by heating the heat activated adhesive. The heat activated adhesive is activated by melting the heat activated adhesive from a solid phase to a liquid phase. The heat activated adhesive forms an adhesive bond in the liquid phase. The adhesive bond formed by the heat activated adhesive remains intact after the phase of the heat activated adhesive is solidified back into a solid phase.

Interior: As used in this disclosure, the interior is used as a relational term that implies that an object is contained within the boundary of a structure or a space.

Liquid: As used in this disclosure, a liquid refers to a state (phase) of matter that is fluid and that maintains, for a given pressure, a fixed volume that is independent of the volume of the container.

Monomer: As used in this disclosure, a monomer refers to a molecular structure that bonds to itself in a repeating manner to form a polymer.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pad: As used in this disclosure, a pad is a disk-shaped mass of elastic material. A pad is often used: a) for protection against damage or injury; or b) grip security. Commonly used padding materials include, but are not limited to, polyurethane foam and silicone.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Phase Change Terminology: As used in this disclosure, the following terms are used to describe a phase change. A phase change from a solid phase to a liquid phase is called melting. A phase change from a liquid phase to a solid phase is called freezing or solidification. A phase change from a solid phase to a gas phase is called sublimation. A phase change from a gas phase to a solid phase is called deposition. A phase change from a liquid phase to a gas phase is called evaporation. A phase change from a gas phase to a liquid phase is called condensation. A phase change from a gas phase to a plasma phase is called ionization. A phase change from a plasma phase to a gas phase is called recombination.

Plasma: As used in this disclosure, plasma refers to a state (phase) of matter wherein the outer valence electrons of an atom (or molecule) have been separated from their nucleus but remain with the matter. A plasma is an electrically neutral state of matter that is formed from the ions of the separated atoms. Plasmas generally, but not necessarily behaves like a gas in that a plasma fills the volume of the structure that contains it. The flow of a plasma through the atmosphere is called an arc. An arc is generally created when the atmosphere is subjected to an electric field that ionizes the molecules forming the atmosphere.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Posterior: As used in this disclosure, posterior is a term that is used to refer to the side of an object that is distal or in the opposite direction of the anterior side. When comparing two items, the posterior item is the item that is distal from the anterior of the object.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Roughly: As used in this disclosure, roughly refers to a comparison between two objects. Roughly means that the difference between one or more parameters of the two compared objects are not significantly different.

Sandwich: As used in this disclosure, to sandwich means to insert a first disk-shaped structure between a second disk-shaped structure and a third disk-shaped structure to form a composite prism structure. Specifically: a) a first congruent end of the first disk-shaped structure is placed against a first interior congruent end of the second disk-shaped structure; and, b) a second congruent end of the first disk-shaped structure is placed against a second interior congruent end of the third disk-shaped structure. A first exterior congruent end of the second disk-shaped structure forms a first overall congruent end of the overall composite prism structure described in this definition. A second exterior congruent end of the third disk-shaped structure forms a second overall congruent end of the overall composite prism structure described in this definition. The second overall congruent end of the overall composite prism structure is distal from the first overall congruent end. The verb to sandwich describes the act of placing the first disk-shaped structure between the second disk-shaped structure and the third disk-shaped structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Solid: As used in this disclosure, a solid refers to a state (phase) of matter that: 1) has a fixed volume; and, 2) does not flow.

Textile: As used in this disclosure, a textile is a material that is woven, knitted, braided, or felted. Synonyms in common usage for this definition include fabric and cloth. The two surfaces of the textile with the greatest surface area are called the faces of the textile.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A brassiere and applied patch and padding combination for concealing a breast nipple from outer exposure comprising a brassiere, a pad structure, and a fastening structure;

wherein the pad structure inserts into the brassiere;

wherein the fastening structure secures the pad structure within the brassiere;

wherein the brassiere further comprises a plurality of cup structures;

wherein the fastening structure comprises a foam base, a first textile structure, a second textile structure, a first adhesive coating, and a second adhesive coating; and wherein the foam base, the first textile structure, the second textile structure, the first adhesive coating, and the second adhesive coating form the layers of the composite structure of the fastening structure.

2. The brassiere and applied patch and padding combination according to claim 1 wherein the patch assembly for brassiere padding and brassiere is a garment;

wherein the fastening structure secures the pad structure into a fixed position within the brassiere.

3. The brassiere and applied patch and padding combination according to claim 2 wherein each individual cup structure forms a protected space;

wherein each individual cup structure is formed as a non-Euclidean disk structure;

wherein the fastening structure fits flush within the individual cup structure; and wherein the pad structure fits flush within the individual cup structure.

4. The brassiere and applied patch and padding combination according to claim 3 wherein the pad structure is a disk shaped structure;

wherein the pad structure is an elastic structure;

wherein the pad structure forms a cushion that inserts into an individual cup structure selected from the plurality of cup structures of the brassiere; and wherein the pad structure has a non-Euclidean disk shape.

5. The brassiere and applied patch and padding combination according to claim 4 wherein the fastening structure is a disk shaped structure;

wherein the fastening structure is an elastic structure;

wherein the fastening structure forms a fastening device that secures the pad structure to its associated individual cup structure;

wherein the fastening structure secures the pad structure into a fixed position relative to the associated individual cup structure;

wherein the fastening structure is formed as a sheeting structure; and wherein the fastening structure is formed as a non-Euclidean disk structure;

wherein the fastening structure has a composite structure.

6. The brassiere and applied patch and padding combination according to claim 5 wherein the fastening structure is geometrically similar to a convex surface of the non-Euclidean disk structure of the pad structure;

wherein the fastening structure is geometrically similar to the concave surface of the non-Euclidean disk structure of the associated individual cup structure;

wherein the fastening structure is sandwiched between the concave surface of the non-Euclidean surface of the disk structure of the individual cup structure and a convex surface of the non-Euclidean disk structure of the pad structure.

7. The brassiere and applied patch and padding combination according to claim 6 wherein the pad structure is geometrically similar to an individual cup structure selected from the plurality of cup structures;

wherein the pad structure inserts into the individual cup structure associated with the pad structure such that the convex surface of the non-Euclidean disk structure of the pad structure rests flush against the concave surface of the non-Euclidean disk structure of the associated individual cup structure.

8. The brassiere and applied patch and padding combination according to claim 7 wherein the foam base is a disk shaped structure;

wherein the foam base is a sheeting structure;

wherein the foam base forms a layer of the composite structure of the fastening structure;

wherein the foam base is a flexible structure;

wherein the foam base is an elastic structure;

wherein the foam base has a non-Euclidean disk shape;

wherein the foam base forms the primary structure of the fastening structure;

wherein the foam base is a foam structure; and wherein the foam base is formed from a polyurethane foam.

9. The brassiere and applied patch and padding combination according to claim 8 wherein the concave surface of the foam base is geometrically similar to the convex surface of the non-Euclidean disk structure of the pad structure;

wherein the convex surface of the foam base is geometrically similar to the concave surface of the non-Euclidean disk structure of the associated individual cup structure.

10. The brassiere and applied patch and padding combination according to claim 9 wherein the first textile structure is a sheeting structure;

wherein the first textile structure forms a layer of the composite structure of the fastening structure;

wherein the first textile structure is geometrically identical to the convex surface of the non-Euclidean disk structure of the foam base;

wherein the first textile structure permanently attaches to the convex surface of the non-Euclidean disk structure of the foam base;

wherein the first textile structure fully encloses the convex surface of the non-Euclidean disk structure of the foam base;

wherein the second textile structure is a sheeting structure;

wherein the second textile structure forms a layer of the composite structure of the fastening structure;

wherein the second textile structure is geometrically identical to the concave surface of the non-Euclidean disk structure of the foam base;

wherein the second textile structure permanently attaches to the concave surface of the non-Euclidean disk structure of the foam base; and wherein the second textile structure fully encloses the concave surface of the non-Euclidean disk structure of the foam base.

11. The brassiere and applied patch and padding combination according to claim 10 wherein the foam base is sandwiched between the first textile structure and the second textile structure.

12. The brassiere and applied patch and padding combination according to claim 11 wherein the first adhesive coating is a heat activated adhesive;

wherein the first adhesive coating forms a layer of the composite structure of the fastening structure;

wherein the first adhesive coating is applied as a coating to the surface of the first textile structure that is distal from the foam base;

wherein the first adhesive coating adheres the convex surface of the composite structure of the fastening structure to the concave surface of the associated individual cup structure;

wherein the second adhesive coating is a heat activated adhesive;

wherein the second adhesive coating forms a layer of the composite structure of the fastening structure;

wherein the second adhesive coating is applied as a coating to the surface of the second textile structure that is distal from the foam base; and wherein the second adhesive coating adheres the concave surface of the composite structure of the fastening structure to the convex surface of the associated pad structure.

* * * * *